US010131067B2

(12) United States Patent
Munteanu

(10) Patent No.: US 10,131,067 B2
(45) Date of Patent: Nov. 20, 2018

(54) CUTTING MACHINE

(71) Applicants: Sorin Munteanu, Chino, CA (US); Michael Koenig, Rancho Mission Viejo, CA (US)

(72) Inventor: Sorin Munteanu, Chino, CA (US)

( * ) Notice: Subject to any disclaimer, the term of this patent is extended or adjusted under 35 U.S.C. 154(b) by 170 days.

(21) Appl. No.: 15/206,042

(22) Filed: Jul. 8, 2016

(65) Prior Publication Data

US 2018/0009124 A1 Jan. 11, 2018

(51) Int. Cl.
*B26D 3/00* (2006.01)
*B26D 1/54* (2006.01)
(Continued)

(52) U.S. Cl.
CPC ..... *B26D 3/006* (2013.01); *B26D 1/48* (2013.01); *B26D 1/54* (2013.01); *B26D 5/005* (2013.01);
(Continued)

(58) Field of Classification Search
CPC . B26D 1/46; B26D 1/54; B26D 1/543; B26D 3/006; Y10T 83/7264;
(Continued)

(56) References Cited

U.S. PATENT DOCUMENTS 3,573,859 A * 4/1971 Sederberg ..... B26F 1/382 83/34
5,001,957 A * 3/1991 Steckler ..... B23D 53/005 83/661
(Continued)

FOREIGN PATENT DOCUMENTS

DE 19827381 A1 * 4/1999 ..... B26D 1/46
EP 1122040 A2 * 8/2001 ..... B26D 3/006
(Continued)

OTHER PUBLICATIONS

"Cutlas HK5—Dual Oscillating Blade CNC Foam Cutter," retrieved online Apr. 24, 2016, http://www.cutlascnc.com/CNC-foam-cutters/cutlas-hk5-dual-oscillating-blade-cnc-foam-cutter/.
(Continued)

*Primary Examiner* — Laura M Lee
(74) *Attorney, Agent, or Firm* — Cionca IP Law P.C.; Marin Cionca

(57) ABSTRACT

A cutting machine having a first wheel pair and an opposite second wheel pair, an first vertical wheel, an opposite second vertical wheel, a first drive wheel, a second opposite drive wheel, and a single cutting blade, the first vertical and the second vertical wheels being configured to travel simultaneously and in a same horizontal direction, the first and the second wheel pairs being configured to travel simultaneously and in a same vertical direction, the first wheel pair having a first slanted wheel and the second wheel pair having a second slanted wheel, the single cutting blade being routed over all wheels such that at any moment during a travel of the single cutting blade while driven by the first and second drive wheels, a vertical blade portion extends between and can travel horizontally with the first vertical wheel and the second vertical wheel during vertical cutting and a horizontal blade portion extends between and can travel vertically with the first and second wheel pairs during horizontal cutting, wherein the slant of the first slanted wheel and the slant of the second slanted wheel prevents intersection of the horizontal blade portion and the vertical blade portion.

17 Claims, 8 Drawing Sheets

(51) Int. Cl.

| | |
|---|---|
| ***B26D 1/48*** | (2006.01) |
| ***B26D 7/06*** | (2006.01) |
| ***B26D 5/00*** | (2006.01) |
| ***B26F 1/38*** | (2006.01) |
| ***B26D 7/02*** | (2006.01) |

(52) U.S. Cl.
CPC ..... *B26D 7/025* (2013.01); *B26D 7/0625* (2013.01); *B26F 1/3833* (2013.01); *Y10T 83/707* (2015.04); *Y10T 83/7264* (2015.04)

(58) Field of Classification Search
CPC ..... Y10T 83/6582; Y10T 83/6595; Y10T 83/6603; Y10T 83/7101; B23D 57/0023
See application file for complete search history.

(56) References Cited

U.S. PATENT DOCUMENTS 5,050,472 A 9/1991 Potzsch
6,125,733 A * 10/2000 Hwang ..... B26D 1/46 83/651.1
6,199,468 B1 * 3/2001 Hackbarth ..... B26D 1/46 451/182
6,386,083 B1 * 5/2002 Hwang ..... B26F 1/3833 83/651.1
6,868,765 B2 * 3/2005 Poetzsch ..... B26D 3/006 83/174
2001/0017072 A1 * 8/2001 Poetzsch ..... B26D 3/006 83/174

FOREIGN PATENT DOCUMENTS

WO WO 9749530 A1 * 12/1997 ..... B26D 1/46
WO WO 2008138064 A1 * 11/2008 ..... B23D 57/0023

OTHER PUBLICATIONS

"Dual Oscillating Blade Contour Cutter," retrieved online Apr. 24, 2016, http://www.demandproducts.com/Flexible-Foam-items/item.php?I2=2,30,17&sku=WDOZ2000.
"Machine Type: Combined Contour Cutting, CF 67," retrieved online Apr. 24, 2016, http://www.fecken-kirfel.com/en/products/maschine.html?id=0DAA6FD7EDA43F69C125724A002D74E5.

* cited by examiner

CUTTING MACHINE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF INVENTION

1. Field of the Invention

The invention relates generally to cutting machinery and more specifically to high-speed contour foam sponge cutting machines.

2. Description of the Related Art

Cutting machines are able to cut in two planes, but use two different blades to do so and cannot use a single blade to accomplish cuts in different planes. When cutting a contour into a piece of foam, the contour is established by cutting in one plane, and then moving the foam into a different position so that the next blade can cut in another plane. Most finished foam products require two operations for the cutting to be complete. This is often done with two machines, with one cutting in one direction and the second cutting in another. As an example, the first machine can cut regular horizontal straight sheets in a stack arrangement with a horizontal blade, and a second machine can cut contours out of these sheets with a vertical blade. As another example, a horizontal contour blade can cut contours in horizontal logs, and a second machine or operation is needed to cut the logs to a desired length. This requires two machines with two operations, which means that extra space and storage are needed between the two machines. Extra handling of the foam is also required, which reduces the consistency and accuracy of cuts.

Combination machines with two cutting blades, such as machines that use vibrating blades as cutting devices, may have slow speed capabilities that are not suitable for high volume production. Another known machine has two separate cutting units, each with its own cutting blade, but lacks a way to secure the foam block during the cutting process. The distance between the two cutting blades may be approximately four feet. This can cause problems because, during transport from the first blade to the second, the foam can move from its original position, particularly since foam is flexible and may shift in position, and the second cut in the cutting program may not register properly with the first cut. This can result in cuts that are misaligned. Users have tried to prevent the foam blocks from moving by, for example, taping the block together, or putting additional foam blocks on each side of the original block to prevent movements, but these solutions do not provide secure holds. Manufacturers of contour cutting machines also have provided additional block guidance systems, but these are installed on the sides of the block and not the front and back where the holding together is most needed. Therefore, a solution is needed for increased precision during cutting, and for preventing movement of the foam block that is to be cut, such that more accuracy and consistency between the horizontal and vertical cuts can be achieved. Since the foam block moves in a front to back direction, rapid acceleration and/or deceleration results in the block wiggling, especially towards the top of the block. Block guidance systems on the sides or top of the block as known in the prior art are not sufficient for supporting the foam block to prevent this movement, since additional support is needed in the front and back for that restriction of movement.

Continuous band knife machines as known in the art may have drive wheels that are in contact with the band knife only for a quarter of the wheel's circumference. The wheels may be coated with rubber or a polyurethane material to ensure good friction and positive drive. However, due to the high tension and the narrow width of the blade of the band knife, the drive wheels may wear out in a short amount of time, and need to be repaired or replaced. Thus, a solution is needed for extending the life of the drive wheels.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect a contour cutting machine, with different portions of a single blade, can cut vertically and horizontally. A cutting blade that is a continuous type traveling on a plurality of wheels is provided, wherein two of the plurality of wheels are mounted at an angle relative to the others, such that the blade is transferred from one plane to another. A horizontal portion of the blade between the horizontal pair of wheels and a vertical portion of the blade between the vertical pair of wheels can rotate on their axes, such that the sharp edge of the cutting blade is always pointed towards the direction of cutting. The two planes of cutting, horizontal and vertical, may be approximately one inch apart. Thus, an advantage is the precision and registration of the combined horizontal and vertical programs are increased. Another advantage is that less space is needed than when two machines are used. Another advantage is that the speed of the cutting is higher than when two machines are used.

In an aspect a continuous band knife cutting machine is provided wherein the cutting machine is equipped with two drive wheels synchronized from the same drive inverter. A doubling of the drive contact area is provided, totaling half the wheel's circumference rather than a quarter of a wheel's circumference such as in the continuous band knife cutting machines known in the art. Thus, an advantage is steel surfaced wheels may be used, which may have a longer life span than the wheels used in the prior art.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1A:
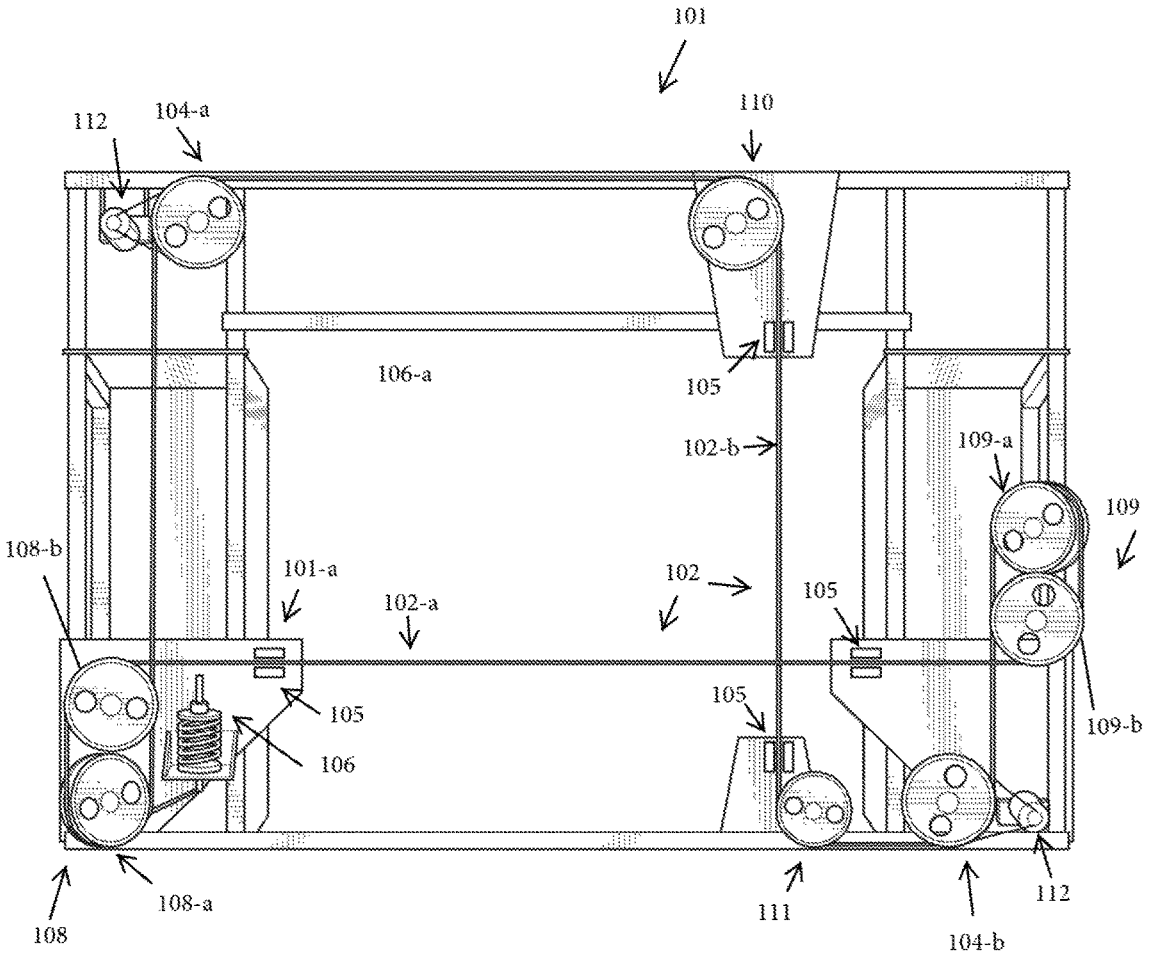
FIG. 1*a* illustrates the front view of a single-blade cutting machine, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

For the following description, it can be assumed that most correspondingly labeled elements across the figures (e.g., 101 and 201, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1*a* illustrates the front view of a single-blade cutting machine 101, according to an aspect. The blade 102 of the machine may be a band knife, and the single-blade cutting machine 101 may include a plurality of wheels or pulleys. The wheels may be parallel to each other and positioned transversally as shown to the direction of travel (front-to-back or vice versa in FIG. 1) of the object to be cut (e.g., foam block)") of the cutting machine 101, with the exception of, for example, two wheels 108-*a* and 109-*a*, which may be mounted at an angle, as it will be described in more detail hereinafter. The cutting machine 101 may include two opposite pairs of wheels, a left pair 108 which may include a first slanted wheel 108-*a* ("first slanted wheel," or "first angled wheel"), and a right pair 109, which may include a second slanted wheel 109-*a* ("second slanted wheel" or "second angled wheel"). Wheel 108-*b* and wheel 109-*b*, which are part of the left wheel pair 108 and right wheel pair 109, respectively, may be parallel to each of the other wheels of the plurality of wheels of the cutting machine 101, with the exception of the first slanted wheel and the second slanted wheel. The cutting machine 101 may also include a top vertical wheel 110, and a bottom vertical wheel 111, which, again, may be parallel to each of the other wheels of the plurality of wheels of the cutting machine 101, with the exception of the first slanted wheel and the second slanted wheel.

As shown, the blade 102 may be routed such that at any given time during blade's travel, a portion of the blade 102-*a* (herein "horizontal portion," "horizontal blade portion," or "horizontal portion of the blade") may travel horizontally across the cutting machine 101, between the left wheel pair 108 and the right wheel pair 109 (or vice versa) as shown, and the horizontal portion 102-*a* may also move up and down, while traveling horizontally, to perform cuts. The up and down motion may be achieved by the left pair 108 and right pair 109 of wheels being configured for moving up and down together.

As shown, the blade 102 may be routed such that at any given time during blade's travel, a second portion of the blade 102-*b* (herein "vertical portion," "vertical blade portion," or "vertical portion of the blade") may travel vertically across the cutting machine 101, between the top vertical wheel 110 and the bottom vertical wheel 111 as shown, and the vertical portion 102-*b* may also move side to side, while traveling vertically, to perform cuts. Similarly to the horizontal cutting, the side to side motion may be achieved by the top vertical wheel 110 and the bottom vertical wheel 111 being configured for moving side to side together. A tensioner 106, coil-based for example, as shown, may be provided, which may be used to adjust the tension in blade 102 to a desired level, and ensuring that the blade 102 can maintain the same tension during the movement of the wheel pairs 108 and 109 and vertical wheels 110 and 111.

The horizontal blade portion 102-*a* and the vertical blade portion 102-*b* may be positioned in different planes, such that they do not touch each other. The same single blade 102 operating in two planes may be achieved by the slant of the wheels 108-*a* and 109-*a*, which may move the vertical portion 102-*b* behind and away from the horizontal portion 102-*a* at a distance of approximately one inch, for example. As shown, the blade 102 may be routed such that at any given time during blade's taravel, a second portion of the blade 102-*b* (herein "vertical portion," "vertical blade portion," or "vertical portion of the blade") may travel vertically across the cutting machine 101, between the top vertical wheel 110 and the bottom vertical wheel 111 as shown, and the vertical portion 102-*b* may also move side to side, while traveling vertically, to perform cuts. Similarly to the horizontal cutting, the side to side motion may be achieved by the top vertical wheel 110 and the bottom vertical wheel 111 being configured for moving side to side together. A tensioner 106, coil-based for example, as shown, may be provided, which may be used to adjust the tension in blade 102 to a desired level, and ensuring that the blade 102 can maintain the same tension during the movement of the wheel pairs 108 and 109 and vertical wheels 110 and 111.

The distance between the two blade portions 102-*a* and 102-*b* may be smaller or larger than one inch depending on, for example, the size of the wheels used in the cutting machine 101.

During the loading of a foam block (not shown) onto the cutting machine 101, both the horizontal portion 102-*a* and vertical portion 102-*b* of the blade 102 may be in their parked positions. The parked position of the vertical blade portion may be all the way to the side of the cutting machine 101, such as, for example, the right side of the FIG. 1*a*, and the parked position of the horizontal blade portion 102-*a* may be all the way at the top of the cutting machine 101. The foam block may be secured with adjustable fences (as shown by 309 in FIG. 3). The cutting machine 101 may be configured for using a single automatic program to bring each portion (horizontal and/or vertical portion) of the blade into action as needed, and parking each blade portion when it is not in use.

The cutting machine 101 may be equipped with driving wheels 104-*a* and 104-*b*, which may be synchronized from the same drive inverter. The belts 112 to which the driving wheels 104-*a* and 104-*b* are connected may be driven by an electric motor (not shown). The driving wheels 104-*a* and 104-*b* may be fixed in their positions. By using two driving wheels, the drive contact area may be twice that of using only one driving wheel, which may provide sufficient friction to, for example, prevent slippage, even if steel surface driving wheels are used, which may help with proper operation of the machine and may also extend the life of the driving wheels. The drive contact area may total about half of a wheel circumference. Again, the increase in the drive contact area may make possible the use of durable steel surface wheels, such as, for example, rubber coated wheels, or any other type of wheels.

It should be understood that in an alternative embodiment, the cutting machine depicted in FIG. 1*a* can be rotated, for example, with 90 (ninety) degrees counterclockwise, and achieve same or similar functionality as described herein with respect to FIG. 1*a* and subsequent figures. In such alternative embodiment, for example, the right pair of wheels 109 will be at the top, and horizontal blade portion 102-*a* will become the vertical blade portion.

Figure 1B:
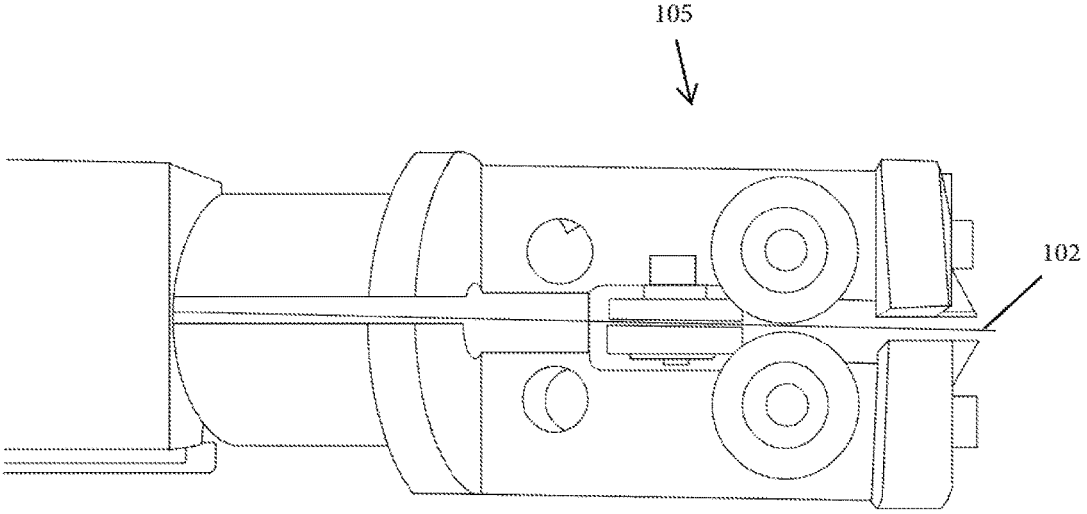
FIG. 1*b* shows an example of the front view of a knife rotator, as known in the art.

FIG. 1*b* shows an example of the front view of a knife rotator 105, as known in the art. As shown in FIG. 1*a*, the cutting machine 101 may include knife rotators 105 (a horizontal pair and a vertical pair), such as the example shown in FIG. 1*b*, to rotate the horizontal portion 102-*a* and vertical portion 102-*b* of the blade as needed, such that the sharp edge of the blade is always pointed towards the direction of cutting. The knife rotators 105 may be mounted to the frame 101-*a* of the cutting machine 101, and may move in conjunction with the movements described above of the wheel pairs 108 and 109, and wheels 110, and 111.

Figure 2:
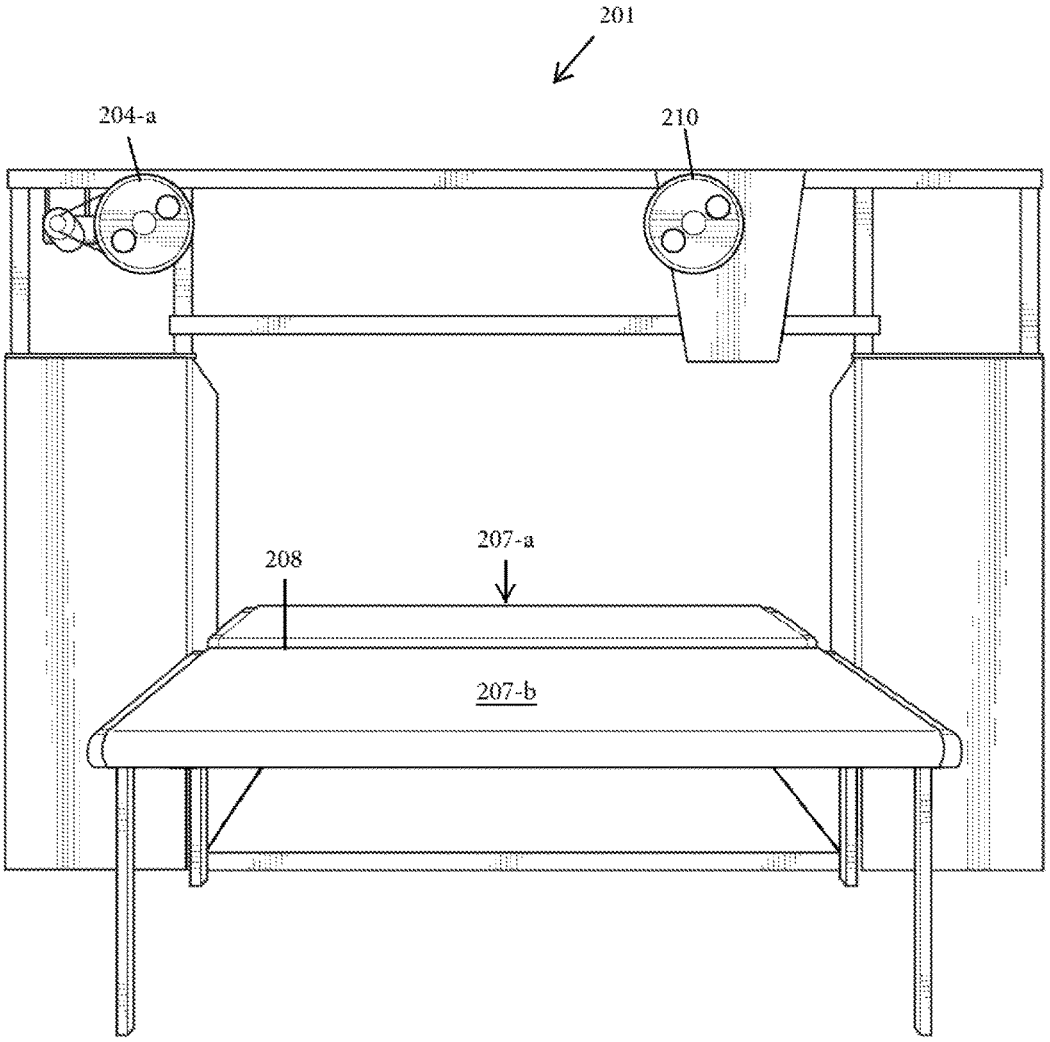
FIG. 2 illustrates a simplified front view of a single-blade cutting machine, according to an aspect.

FIG. 2 illustrates a simplified front view of a single-blade cutting machine 201, according to an aspect. Only driving wheel 204-*a* and top vertical wheel 210 are shown for clarity of the cutting machine 201. The cutting machine 201 may be equipped with two conveyer belts 207-*a* and 207-*b*, such that a small gap 208 is provided between the conveyer belts 207-*a* and 207-*b*. The gap 208 may be used for the blade portions to pass while performing the cuts, as shown in more detail in FIG. 3. The conveyer belts 207-*a* and 207-*b* may be capable of moving a foam block to be cut in a front to back direction, or a back to front direction, passing the foam block over the gap 208 as necessary to obtain the shape to be cut.

Figure 3:
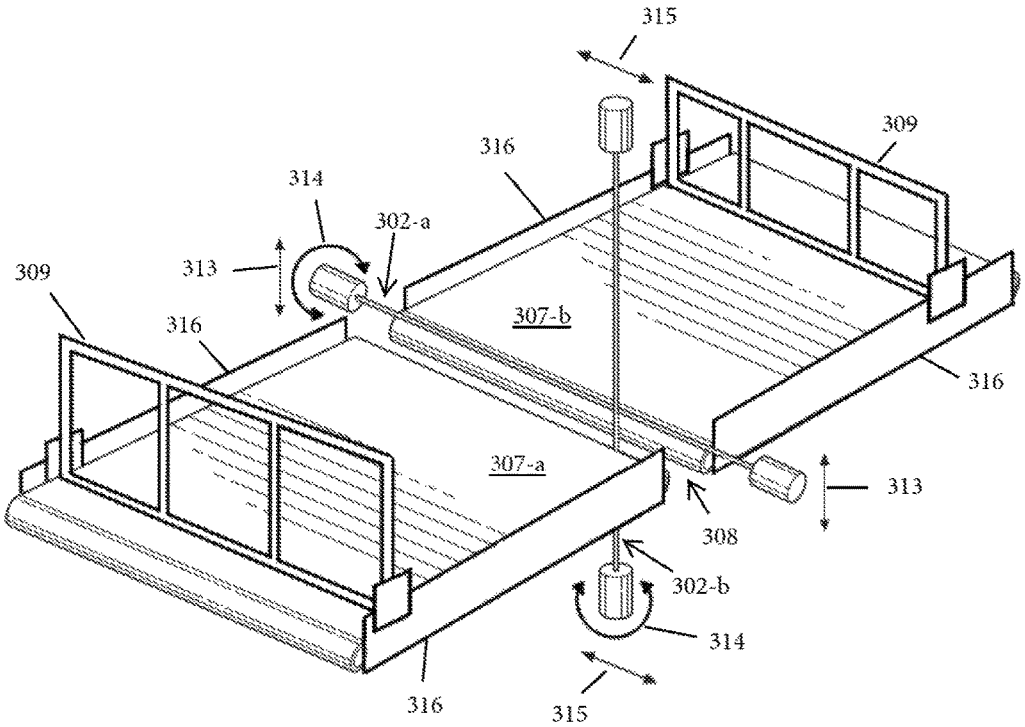
FIG. 3 illustrates the top side perspective view of two conveyer belts and portions of the blade of the single-blade cutting machine, according to an aspect.

FIG. 3 illustrates the top side perspective view of two conveyer belts 307-*a* and 307-*b*, respectively, and the horizontal portion 302-*a* and the vertical portion 302-*b* of the blade 102 of the single-blade cutting machine 101, according to an aspect. The first conveyer belt 307-*b* may be proximate to the front of the cutting machine 101, and the second conveyer belt 307-*a* may be proximate to the back of the cutting machine 101. The curved directional arrows 314 indicate the ability of the horizontal 302-*a* and vertical 302-*b* blade portions to rotate, such that the sharp edge of the blade can be angled as needed. The directional arrows 313 indicates the ability of the horizontal portion 302-*a* of the blade to move up-and-down in a vertical plane, as described hereinbefore. The directional arrows 315 indicates the ability of the vertical portion 302-*b* of the blade to move side-to-side in another vertical plane, as described hereinbefore. Both the horizontal portion 302-*a* and particularly the vertical portion 302-*b* as shown may move in their respective planes by passing through the gap 308 between the two conveyer belts 307-*a* and 307-*b*. Adjustable fences 309 to secure the foam block may be provided. These fences 309 may open and close by swinging out, and may be used to secure the foam block in the direction of travel, rather than securing the block from the sides. This has the advantage of securing the foam block in the direction of its travel as it is being cut, where a secure hold is most needed, again, since front to back is the direction of the inertia of the foam block. The fences 309 may be movably (e.g., slidably) secured to rails 316 on the sides of the conveyer belts 307-*a* and 307-*b*. After securing a foam block (not shown) within the adjustable fences, they will all travel together (e.g., from left to right in FIG. 3), the foam block being transported by the conveyer belts 307*a*-*b*, while the adjustable fences 309 move along on rails 316.

In an example, the process of operating the cutting machine to cut the foam block may have the following steps: first, a foam block may be placed onto a first conveyer belt 307-*b*, from the front side of the cutting machine. Next, the drive wheels may be started, such that the single blade travels continuously on the wheels as described. Next, the foam block may advance towards the second conveyer belt 307-*a* while the horizontal blade portion 302-*a* and the vertical blade portion 302-*b* engage the foam block at the same time, as described, according to the shape to be cut out of the foam block, the blade portions rotating during cutting, as described. In another example, ONLY ONE of the blade portions engages the foam block and when that cut is completed, and only after that cut is completed, the other blade portion engages the foam block.

The above steps may be used as an algorithm for programming the cutting machine, such that the process is automated. The automation can be accomplished by using software run by a processor, using a programmable logic controller (PLC), or any other similar controlling means as known in the art. In a typical usage of the machine, each portion of the blade may run separately, to allow cutting of any conceivable profile or part possible. The controller may be able to command both portions of the blade to move at the same time, which may be done to cut symmetrically on both the horizontal and verticle planes.

Figure 4:
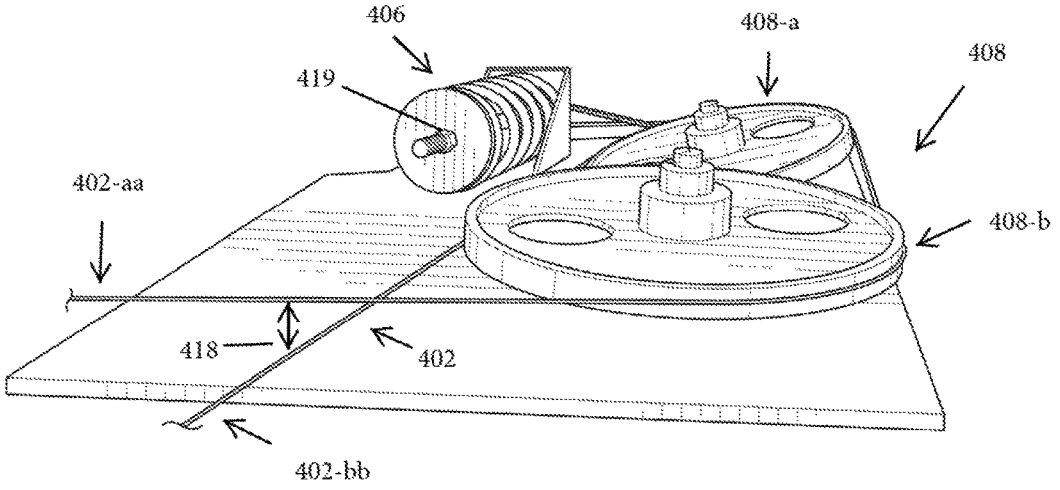
FIG. 4 illustrates the top perspective view of the left horizontal pair of wheels and tension coil of the single-blade cutting machine, according to an aspect.

FIG. 4 illustrates the top perspective view of the left horizontal pair of wheels 408 and tension coil 406 of the single-blade cutting machine, according to an aspect. The first angled wheel 408-*a* may be angled towards the center of the cutting machine, shown as the left side of FIG. 4. As the blade 402 loops around wheel 408-*b* and then around the first angled wheel 408-*a*, the slant of the first angled wheel 408-*a* may lower the portion of the blade 402-*bb* such that it is in a different plane than the portion of the blade 402-*aa*.

As indicated by the double arrow 418, again, the distance between the portions of the blade may be one inch, such that the blade does not cross, rub, or contact itself, while keeping the portions of the blade close enough for accurate cuts and minimizing movement of the foam block during cutting. Again, a tensioner 406, coil-based for example, as shown, may be provided, which may be used to adjust the tension in blade 402 to a desired level, and ensuring that the blade 402 can maintain the same tension during the movement of the wheel pairs (408 as shown in FIG. 4, and 109 and vertical wheels 110 and 111 in FIG. 1). A nut 419, for example, may be used to adjust the tension.

Figure 5:
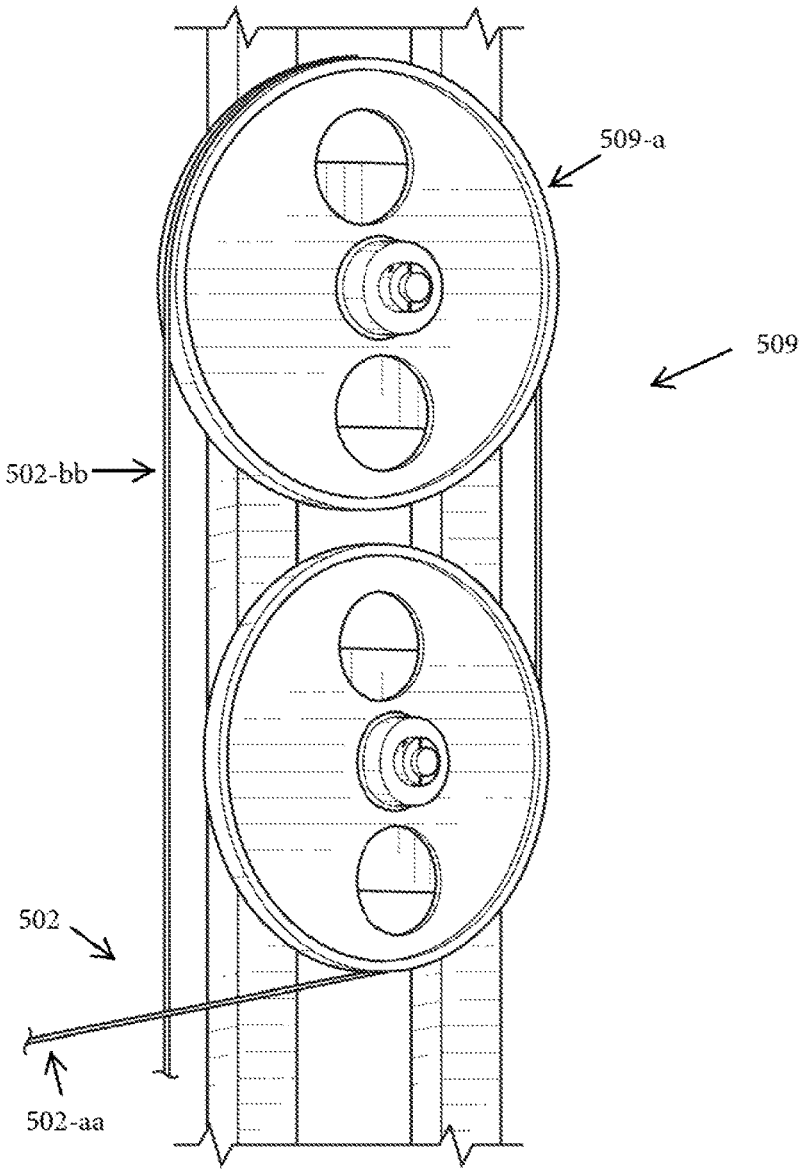
FIG. 5 illustrates the front perspective view of the right horizontal pair of wheels of the single-blade cutting machine, according to an aspect.

FIG. 5 illustrates the front perspective view of the right horizontal pair of wheels 509 of the single-blade cutting machine, according to an aspect. The second angled wheel 509-*a* may lower the blade 502 such that the portion of the blade 502-*bb* is in a different plane than the portion 502-*aa*, as also shown in FIG. 4. The portion of the blade 502-*bb* may be situated behind the portion of the blade 502-*aa* when viewing the cutting machine from the front, as shown in FIG. 1.

Figure 6:
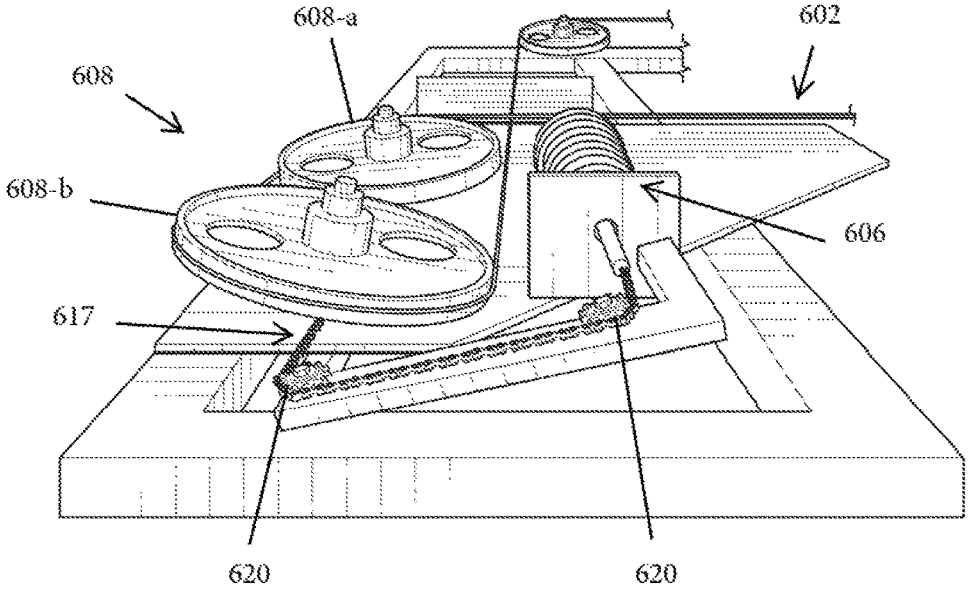
FIG. 6 illustrates the bottom perspective view of the left set of horizontal wheels and tension coil of the single-blade cutting machine, according to an aspect.

FIG. 6 illustrates the bottom perspective view of the left horizontal pair of wheels 608 and tension coil 606 of the single-blade cutting machine, according to an aspect. The tensioner 606 may be used to adjust and maintain the blade 602 tight. The tensioner 606 may be spring/coil based and may be configured as in the example shown. For example, the wheel 608-*a* may be configured to slide into an underneath channel (not shown) such that when a nut (seen in FIG. 4 at 419) is tightened, a chain 617 guided by gears 620 pulls wheel 608-*a* away from wheel 608-*b*, thus increasing the tension in blade 602.

Figure 7:
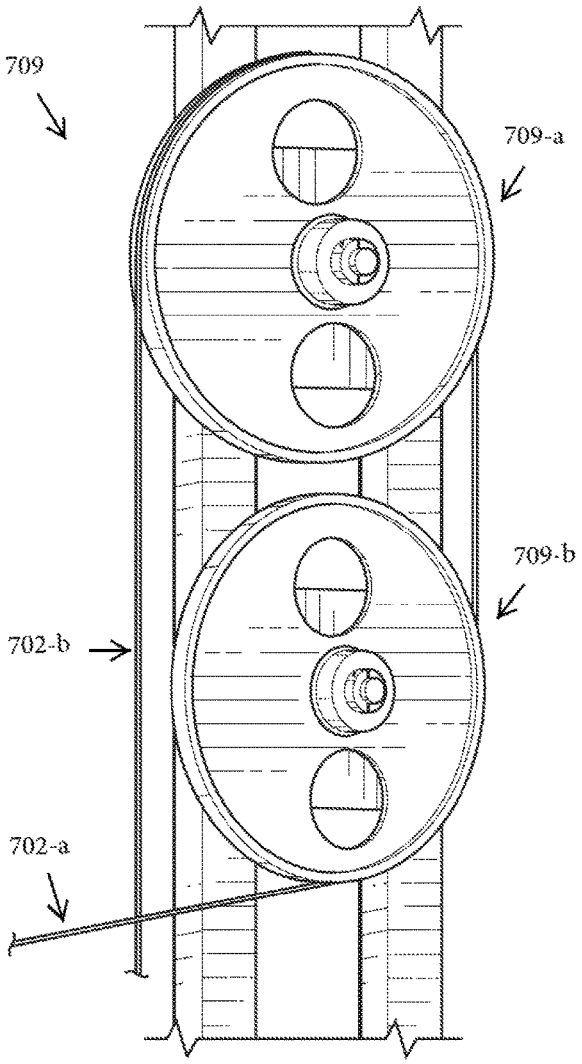
FIG. 7 illustrates the front perspective view of the right horizontal pair of wheels of the single-blade cutting machine, according to an aspect.

FIG. 7 illustrates the front perspective view of the right horizontal pair of wheels 709 of the single-blade cutting machine, according to an aspect. As shown, and as described herein before when referring to FIG. 1, the vertical portion 702-*b* of the blade may pass behind the horizontal portion 702-*a* because of the slanting of wheel 709*a*.

Figure 8:
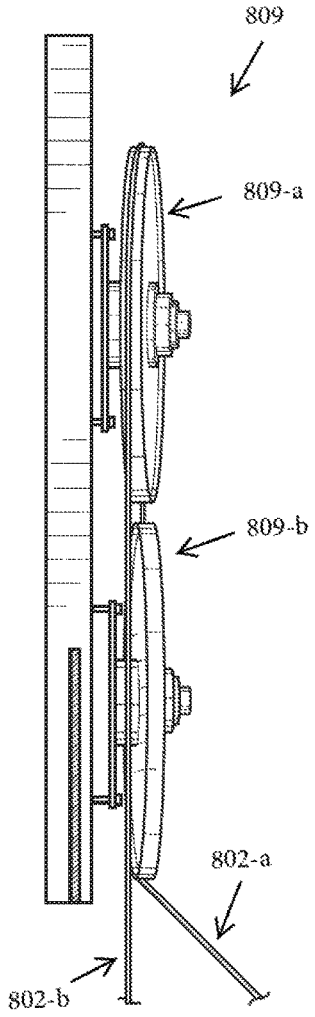
FIG. 8 illustrates the side perspective view of the right horizontal pair of wheels of the single-blade cutting machine, according to an aspect.

FIG. 8 illustrates the side perspective view of the right horizontal pair of wheels 809 of the single-blade cutting machine, according to an aspect. The second angled wheel 809-*a* may be slanted towards the center of the cutting machine as described herein before when referring to FIG. 1. Again, because of the slanting of wheel 809-*a*, the vertical portion 802-*b* may pass behind (as shown as the left side of FIG. 8) the horizontal portion 802-*a*.

It should be understood that while the cutting machine disclosed herein in an example is configured to cut foam, similarly the cutting machine may be used to cut other materials.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

The invention claimed is:

1. A cutting machine comprising a frame having an upper, a lower, a left and a right edge; a left wheel pair and an opposite right wheel pair; an upper vertical wheel; an opposite lower vertical wheel; a first drive wheel positioned near an upper-left corner of the frame; a second opposite drive wheel positioned near an opposite lower-right corner of the frame; and a single cutting blade, wherein the single cutting blade is a band knife; the left wheel pair having a lower slanted wheel and an upper left wheel disposed above the lower slanted wheel; the right wheel pair having an upper slanted wheel and a lower right wheel disposed below the upper slanted wheel; the single cutting blade being routed such that at any moment during a travel of the single cutting blade a vertical blade portion of the single cutting blade extends between the upper vertical wheel and the lower vertical wheel and a horizontal blade portion extends between the left and right wheel pairs; the vertical blade portion together with the upper vertical and the lower vertical wheels being configured to travel simultaneously and in a same horizontal direction while a block of material advances through the cutting machine, thus allowing for vertical contour cutting by the vertical portion of the single cutting blade; the horizontal blade portion together with the left and the right wheel pairs being configured to travel simultaneously and in a same vertical direction, while the block of material advances through the cutting machine, thus allowing for horizontal contour cutting by the horizontal portion of the single cutting blade; the vertical blade portion being positioned at a set distance apart from the horizontal blade portion.

2. The cutting machine of claim 1, wherein the set distance is one inch.

3. The cutting machine of claim 1, further comprising a horizontal pair of knife rotators for rotating the horizontal blade portion and a vertical pair of knife rotators for rotating the vertical blade portion during cutting, such that a sharp edge of the blade portions is pointed towards a direction of cutting.

4. The cutting machine of claim 1, further comprising a tensioner for adjusting the tension in the single cutting blade.

5. The cutting machine of claim 4, wherein the tensioner is mobile and travels with the left wheel pair.

6. The cutting machine of claim 4, wherein the tensioner acts upon the lower slanted wheel, which can move away from a center of the left wheel pair.

7. The cutting machine of claim 1, further comprising two conveyer belts configured for moving the block of material through the cutting machine.

8. The cutting machine of claim 7, wherein the block of material is a foam block.

9. The cutting machine of claim 7, further comprising two adjustable fences for securing the block of material at a front and a back end, the adjustable fences being configured to slide on a pair of rails with the block of material during cutting.

10. The cutting machine of claim 1, wherein the horizontal blade portion and the left and right wheel pairs are located near the upper edge of the frame.

11. The cutting machine of claim 1, wherein the vertical blade portion and the upper and lower vertical wheels are located near the right edge of the frame.

12. A cutting machine having a left, a right, a lower and an upper side and comprising a single blade configured to cut vertically and horizontally, the single blade being a band knife and being routed on a first drive wheel, a first upper vertical wheel, a second lower vertical wheel, a second drive wheel, a right wheel pair comprising a slanted upper right wheel and a lower right wheel, a left wheel pair comprising an upper left wheel and a slanted lower left wheel, the two wheels in each of the left and right wheel pairs being configured to cooperate in order to transfer the band knife between horizontal and vertical planes, such that a sharp edge of the band knife is always pointed towards a vertical and a horizontal direction of cutting; the blade routing forming a vertical blade portion that can cut vertically and that can move between the left and the right side during cutting, while a block of material advances through the cutting machine, thus allowing for vertical contour cutting by the vertical portion of the single cutting blade, and a horizontal blade portion that can cut horizontally and that can move between the upper and the lower side during cutting, while the block of material advances through the cutting machine, thus allowing for horizontal contour cutting by the horizontal portion of the single cutting blade.

13. The cutting machine of claim 12, wherein the first and the second drive wheels are mounted in diagonally opposite corners of the cutting machine and wherein the single blade is routed on about a quarter of each wheel.

14. The cutting machine of claim 12, wherein the slant of the upper right wheel and the slant of the lower left wheel prevents intersection of the horizontal blade portion and the vertical blade portion.

15. The cutting machine of claim 12, wherein the first upper vertical wheel and the second lower vertical wheel move together with the vertical blade portion between the left and the right side.

16. The cutting machine of claim 12, wherein the slanted upper right wheel, the lower right wheel, the upper left wheel and the slanted lower left wheel all move together with the horizontal blade portion between the upper and the lower side.

17. A cutting machine comprising a first wheel pair and an opposite second wheel pair, an first vertical wheel, an opposite second vertical wheel, a first drive wheel, a second opposite drive wheel, and a single cutting blade, wherein the single cutting blade is a band knife, the first wheel pair having a first slanted wheel and the second wheel pair having a second slanted wheel, the single cutting blade being routed over all wheels such that at any moment during a travel of the single cutting blade while driven by the first and second drive wheels, a vertical blade portion extends between the first vertical wheel and the second vertical wheel and a horizontal blade portion extends between the first and second wheel pairs, wherein the slant of the first slanted wheel and the slant of the second slanted wheel prevents intersection of the horizontal blade portion and the vertical blade portion, the vertical blade portion together with the first vertical and the second vertical wheels being configured to travel simultaneously and in a same horizontal direction while a block of material advances through the cutting machine, thus allowing for vertical contour cutting by the vertical portion of the single cutting blade; the horizontal blade portion together with the first and the second wheel pairs being configured to travel simultaneously and in a same vertical direction, while the block of material advances through the cutting machine, thus allowing for horizontal contour cutting by the horizontal portion of the single cutting blade.

* * * * *